US006095364A

United States Patent [19]

Dickie et al.

[11] Patent Number: 6,095,364

[45] Date of Patent: Aug. 1, 2000

[54] CHILD-RESISTANT CLOSURE FOR PILL CONTAINERS

[75] Inventors: Robert G. Dickie, Newmarket; Maurice Tousson, Thornhill, both of Canada

[73] Assignee: Medex Packaging Inc., Mississauga

[21] Appl. No.: 09/296,713

[22] Filed: Apr. 9, 1999

[51] Int. Cl.[7] ..... B65D 43/12; B65D 45/16; B65D 83/04

[52] U.S. Cl. ..... 220/254; 206/459.5; 206/534; 220/324; 220/835; 220/837

[58] Field of Search ..... 220/838, 837, 220/834, 833, 254, 259, 265; 215/235, 237; 206/459.5, 534

[56] References Cited

U.S. PATENT DOCUMENTS

| | | | |
|---|---|---|---|
| 3,964,609 | 6/1976 | Perrella | 220/254 X |
| 4,144,985 | 3/1979 | Kinslow | 220/254 |
| 4,535,903 | 8/1985 | Franchi . | |
| 4,538,731 | 9/1985 | Cillario | 220/254 X |
| 5,423,441 | 6/1995 | Conti . | |
| 5,819,944 | 10/1998 | Terrasi | 206/540 X |
| 5,887,736 | 8/1999 | Mar . | |

*Primary Examiner*—Allan N. Shoap
*Assistant Examiner*—Rodrigo L. Eichwald
*Attorney, Agent, or Firm*—Marks & Clerk

[57] ABSTRACT

A unitary child-resistant closure for pill containers, comprises a substantially rectangular base having an opening therein. A first fixed cover portion overlies more than 50% of the opening. There is a moveable closure member, and a hinge—usually, a living hinge—connecting the moveable closure member to the rectangular base. The moveable closure member has first and second major surfaces, which are its upper surface and lower surface when the moveable closure member is in its operative closure position. A camming member is upstanding from the second major surface of the moveable closure member at a first end thereof, and presents a sliding cam surface which is sloped in a direction towards the second major surface and away from the hinge. The first end of the camming member has a latch member formed therein, which extends beyond the first end of the moveable closure member and is spaced away from the second major surface by a distance which is at least equal to the thickness of the first fixed cover portion. A flexible spring member is formed between the second end of the camming member and the hinge, and terminates at one end thereof in the hinge. When the moveable closure member is in its operative closure position, the latch member extends beneath a first end of the fixed cover portion, and the first end of the moveable closure member is urged against the first end of the first fixed cover portion by the spring action of the flexible spring member.

16 Claims, 3 Drawing Sheets

CHILD-RESISTANT CLOSURE FOR PILL CONTAINERS

FIELD OF THE INVENTION

This invention relates to child-resistant closures for pill containers. More particularly, this invention relates to child-resistant closures for pill containers, where the closure has a unitary construction—that is, the closure for pill containers is molded as a single piece molded item. Still further, the present invention is directed to the combination of the unitary child-resistant closure for pill containers, a pill container, and a label by which a sealed pill container has an indicator whereby it can be determined whether the pill container has been tampered with after it has been filled with the prescribed medication and sealed by the dispensing pharmacist.

BACKGROUND OF THE INVENTION

There is an increasing awareness of the requirement to protect children from inadvertently gaining access to medications, especially prescribed medications. Sometimes, ingestion of only one or two pills of certain prescribed medications may prove fatal to a child. Moreover, there is an increasing awareness of the necessity to provide containers for prescribed medications which may otherwise may be readily and easily opened by an adult—that is, any person having the cognitive ability to understand the instructions for opening a pill container which requires certain manipulation and manual dexterity. Such persons are assumed, as well, to have the ability to understand that opening a pill container to gain access to the prescribed medication therein is a deliberate action, and is only undertaken when there is a necessity to attain access to the prescribed medication in the pill container.

It is also recognized that an adult person, as described above, may have sufficient manual dexterity to open a pill container, especially prior art pill containers as discussed hereafter, but may suffer from a debilitating condition such as arthritis. Such persons may generally be more elderly than the general population but, because of their living arrangement or perhaps the continuing expectation of visits by active and curious grandchildren, they may instruct their pharmacist to dispense their prescribed medications in pill containers that require specific manipulation and manual dexterity, but with lesser physical effort, but which are still child-resistant. The present invention will accommodate those criteria, unlike prior art pill containers.

Moreover, there is an increasing awareness that patients who receive a pill container of prescribed medications may wish to be assured in their own minds that the pill container has not been tampered with in the interval between when the dispensing pharmacist closed the container and when the container was delivered to the patient or a caregiver looking after the patient. The present invention provides a means for determining whether a container having prescribed medications therein has been tampered with after it was sealed by the dispensing pharmacist.

There are several well-known, so-called, child-proof or child-resistant pill containers in the market, and which are generally employed by dispensing pharmacists for using in filling prescriptions, where the prescription requires that the pharmacist dispense one or more of a plurality of pills, tablets, gel-caps, capsules, or the like. They include the so-called "push-and-turn" closures for pill containers, or "arrow-alignment" closures for pill containers. In both cases, the pill containers are of the standard cylindrical variety.

The push-and-turn system for pill containers requires that the closure or cap for the pill container be pushed axially downwardly and rotated at the same time. Sometimes, very considerable force is required; sometimes the force which is required is beyond that which can easily be exerted by arthritic patients, for example. Moreover, it has been observed that the specific force required between two otherwise identical closures and pill containers, each employing the push-and-turn system, may be different from one to the other.

The arrow-alignment system for pill containers requires relatively good eyesight in order to align an arrow on the closure or cap with an arrow which is usually embossed on the pill container. Even when the arrows are aligned, there is sometimes very considerable force which is required to push up the cap away from the container, so as to remove the cap; and, sometimes, once again, that force is more than can be applied by an arthritic patient.

The question of whether a cap or closure for a pill container is child-resistant or child-proof or not is generally determined by the following criteria:

A child-resistant package must be such that, first, when it is tested by a group which comprises children, the child-resistant package cannot be opened by at least 85% of those children prior to a demonstration to them as to the proper means of opening the package; but still cannot be opened by at least 80% of those children after the demonstration to them of the proper means for opening the package. In the case where a child-resistant package is provided to a test group of adults, it must be capable of being opened by at least 90% of those adults; and, where the package is designed so that it may be re-closed, it can be re-closed by at least 90% of those adults but still cannot be opened by at least 85% of children to whom no demonstration as the proper method of opening the package has been given, nor by 80% of those children after a demonstration has been made.

The general format for pill containers is that they are cylindrical containers, which are not space efficient—in that it may not be easily stacked except in an end-to-end fashion, and even then only precariously. Moreover, placement of a number of cylindrical pill containers together results in an inefficient use of the volume in which they are placed due to the spaces left between the curved cylindrical walls. Still further, so as to read the directions for consumption of the prescribed mediation contained in a cylindrical pill container, the patient or caregiver must turn or rotate the cylindrical pill container to read all of the directions which are placed on a label which is adhesively affixed to the cylindrical pill container.

A particular disadvantage of prior art closures for pill containers, such as those described above, is that, when the cap or closure is removed from the pill container, it is then physically separated from the pill container. This may lead to loss of the closure, in some instances. Moreover, where the patient or caregiver is removing a number of pills from different pill containers to be consumed by the patient at one time, there is a risk that the wrong cap or closure will be put back on any given pill container.

Still further, there is also a risk with cylindrical pill containers in general that children may place the cap in their mouth. In the case where the cap is loose, this might result in choking. In the case where the cap is in place on the pill container, it could result in an advertent opening of the pill container.

If an open cylindrical pill container is dropped or upset, there is a significant risk that all of the remaining pills in the container will be spilled out of it. As will be described hereafter, one of the purposes of the present invention is to minimize that risk.

DESCRIPTION OF THE PRIOR ART

Apart from the generally described prior art closures and pill containers, of the push-and-turn system or the arrow-alignment system, described above, there are several more specific closures and containers which are otherwise representative of advances in the art and which represent differing approaches to the provision of child-proof or safety containers.

FRANCHI U.S. Pat. No. 4,535,903 teaches a child-proof medicine vial whereby a panel is inset into a recess formed in a cap, and is slidable into and out of that cap. The device is said to be child safe when the panel is fully inserted into the cap. An integral hinge is provided so that the cap may be flipped away from, but remain attached to, the vial or container for which it is the closure member.

CONTI U.S. Pat. No. 5,423,441 teaches a child-proof system which has a tamper indicator. Here, there is an annular tear strip on a cap, and a rotatably indexing latch finger which engages a raised annular retainer ridge with a by-pass opening on the neck of the container. A tactile indicator is provided for determining the rotation location of the by-pass opening under the tear strip by sensing it with a finger which is in simultaneous contact with the cap, when the tear strip is removed. However, this closure system still provides for a separate cap which is totally removed from the container.

MAR U.S. Pat. No. 5,887,736 teaches a safety container which requires two simultaneous movements so as to open the container. Essentially, the container is provided with a hinged stopper having a safety latch. The underside of the stopper is provided with a channel which carries a slide pin which can be moved from a first to a second position. In the first latching position, an enlargement at the end of the slide pin is seated in a recess in the lip of the container; and in the second unlatched position, the enlargement is freed from the recess, thereby enabling the stopper to be opened. The slide pin is biassed to its latched position. To open the container, the slide pin is pushed against the bias and, at the same time, the stopper is opened by being hinged upwardly. It is said that these two simultaneous pushing motions are beyond the capability of most young children.

SUMMARY OF THE INVENTION:

In accordance with one aspect of the present invention, there is provided a unitary child-resistant closure for pill containers. The unitary child-resistant closure for pill containers comprises a substantially rectangular base portion having opposed first and second end walls and opposed first and second sidewalls, defining an opening therebetween. A first fixed cover portion overlies more than 50% of the opening, more than 50% of each of the first and second sidewalls, and the second end wall; there is a second moveable closure member; and a hinge connecting the moveable closure member to the first end wall of the rectangular base portion.

The second moveable closure member has first and second major surfaces, which will be the upper surface and the lower surface of the moveable closure member when it is in its operative closure position. Thus, the first major surface of the moveable closure member is the upper surface when the moveable closure member is in its operative closure position whereby it covers the remaining less than 50% of the opening in the rectangular base portion, the remaining less than 50% of the first and second sidewalls of the rectangular base portion, and the first end wall of the rectangular base portion.

The second major surface of the moveable closure member is the lower surface thereof when the moveable closure member is in its operative closure position.

A camming member is upstanding from the second major surface of the moveable closure member at a first end thereof. The camming member presents at least one sliding cam surface which is sloped in a direction towards the second major surface and away from the hinge. The camming member has first and second ends, with the sliding cam surface terminating at the first end thereof.

Moreover, the first end of the camming member has a latch which is formed therein, which latch extends beyond the first end of the moveable closure member. The latch is also spaced away from the second major surface of the moveable closure member by a distance which is at least equal to the thickness of the first fixed cover portion.

There is a flexible spring member which is formed between the second end of the camming member and the hinge. The flexible spring member terminates in the hinge at the end of the flexible spring member which is remote from the second end of the camming member.

Typically, the hinge is a living hinge, but it is noted hereafter that the hinge may also comprise two mating hinge halves which are hingingly secured together by a hinge pin.

When the moveable closure member is in its operative closure position, the latch member extends beneath a first end of the fixed cover portion, which first end is remote from the second end wall of the rectangular base portion, and the first end of the moveable closure member is urged against the first end of the first fixed cover portion by the spring action of the flexible spring member.

The precise mechanical manipulations to open and close the unitary child-resistant closure of the present invention by manipulating the moveable closure member from its operative closure position to an operative open position are described in detail hereafter.

A particular feature of the present invention is that the camming member usually comprises a pair of opposed upstanding camming walls which are formed near the edges of the moveable closure member on the underside or second major surface thereof. Thus, the latch member is actually formed in each of the opposed upstanding camming walls.

Still further, the camming member may also comprise a pair of opposed first and second upstanding end walls, as well as the opposed upstanding camming walls. In this embodiment, the first upstanding end wall is upstanding from the second major surface of the moveable closure member in a location which is behind the latch member, and the flexible spring member terminates at its end which is remote from the hinge in the second upstanding end wall of the camming member.

To provide assistance in opening and closing the moveable closure member from its operative closure position to its operative opening position, as described in detail hereafter, a portion of the edges of the moveable closure member, and a portion of the first major surface of the moveable closure member, may have serrations formed therein.

Generally, the first fixed cover portion of the child-resistant closure of the present invention extends outwardly beyond the second end wall and beyond the first and second sidewalls of the rectangular base portion thereof.

Moreover, in general, the moveable closure member also extends outwardly beyond the first end wall, and beyond the first and second sidewalls of the rectangular base portion, when the moveable closure member is in its operative closure position.

Typically, the first fixed cover portion overlies from 60% to 75% of the opening in the rectangular base portion, and the remaining 25% to 40% of the opening is covered by the moveable closure member when it is in its operative closure position. Thus, the 25% to 40% of the opening which is covered by the moveable closure member will be uncovered when the moveable closure member is in its operative open position.

Another aspect of the present invention provides the combination of the unitary child-resistant closure, as described above, together with a pill container. The pill container also has a substantially rectangular cross-section, with a substantially rectangular open mouth formed at one end thereof. The rectangular cross-section dimensions of the pill container are such as to accommodate the rectangular base portion of the child-resistant closure.

There may be engaging means which are formed in the first and second end walls of the rectangular base portion of the child-resistant closure, and also in first and second end wall of the pill container. Thus, the child-resistant closure may be engagably retained by the engaging means in the pill container and on the end walls of the child-resistant closure, with the substantially rectangular base portion of the child-resistant closure extending into the pill container past the substantially rectangular open mouth thereof.

To assist for a more positive latching condition when the moveable closure member is in it operative closure position, there may be a downwardly extending projection which is formed on the underside of the first fixed cover portion at its first end—against which the first end of the moveable closure member is urged by the spring action of the spring member when the moveable closure member is in its operative closure position.

The present invention particularly provides for the further combination of the child-resistant closure, a pill container, and a label which is adhesively affixed to at least one side of the surface of the pill container and at least to the top surface of the first fixed portion of the child-resistant closure. This will provide for further structural integrity to the pill container with its respective child-resistant closure, once they have been assembled to each other, as discussed in detail hereafter.

Moreover, a portion of the label may also be adhesively affixed to the first major surface of the moveable closure member. Generally, in such circumstances, the label is die-cut so as to have an opening therein through which serrations which are formed on the first major surface and on the edges of the moveable closure member will extend.

In such circumstances as described immediately above, a tamper indicator is thereby provided. In order to assist the patient or caregiver to open the child-resistant closure when access to the medications contained in the pill container is required, perforations may be made in the label in the region thereof which is defined at the intersection of the at least one side surface of the pill container and the first major surface of the closure member.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

Figure 1:
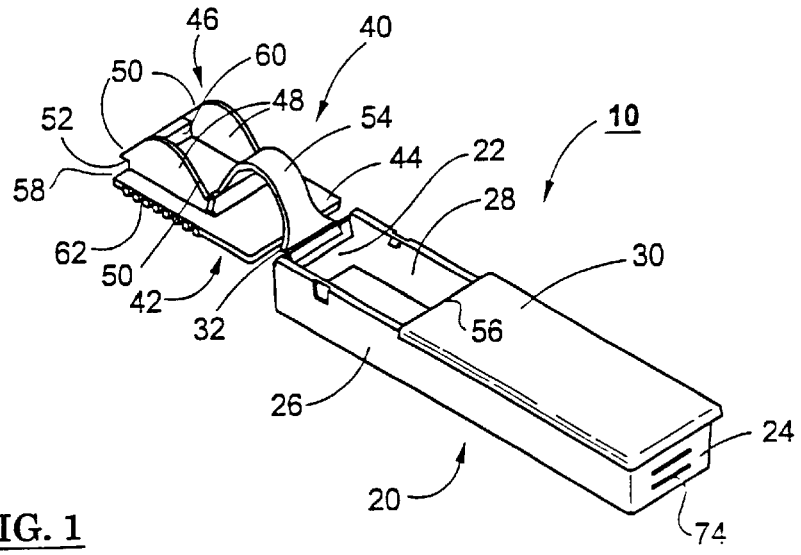
FIG. 1 is a perspective view of a child-resistant closure in keeping with the present invention, in its open, as-molded, configuration.

DETAILED DESCRIPTION OF THE PREFERRED EMBODIMENTS:

It has been noted that the present invention particularly provides a unitary child-resistant closure for pill containers. By "unitary", it is meant that the child-resistant closure may be molded as a single piece, using injection molding techniques; or that the child-resistant closure may be constructed and assembled in such a manner that, once it is assembled, it is not ordinarily possible to be disassembled. Thus, in any and all events, the child-resistant closure of the present invention will exhibit the characteristics of being a unitary or one-piece whole structure.

Moreover, throughout the present disclosure, the use of the word "pill" in describing a pill container or a prescribed medication which is placed in the pill container is meant to refer to any particulate prescribed medications of the sort generally embodied by pills, tablets, caplets, capsules, gelcaps, and the like. Any such medications are prescribed and dispensed by numbers of units—for example, a prescription requiring consumption of three pills daily for ten days requires that thirty such pills be dispensed.

The child-resistant closure is shown generally at 10; a pill container is shown generally at 12. It will be seen from FIGS. 9 and 10, for example, that the size of the pill container 12 may vary, depending on the volume which is required. For example, a pill container into which thirty pills might be dispensed may have a general appearance such as that shown in FIG. 10, whereas a pill container into which ninety pills will be dispensed may have a general appearance such as that shown in FIG. 9.

Referring particularly to FIGS. 1 through 4, it will be seen that the child-resistant closure comprises a substantially rectangular base portion 20. The base portion 20 has first and second end walls 22 and 24, respectively, and opposed first and second sidewalls 26 and 28, respectively. The end walls 22 and 24 and side walls 26 and 28 define an opening therebetween.

There is a first fixed cover portion 30 which overlies more than 50% of the opening which is defined by the end walls 22, 24 and sidewalls 26, 28 of the rectangular base portion 20. It will be seen from FIGS. 1, 2, and 4, in particular, that the first fixed cover portion 30 overlies more than 50% of the opening, and also overlies more than 50% of the first and second side walls 26, 28. As well, the first fixed cover portion 30 overlies the second end wall 24.

The child-resistant closure 10 further comprises a second moveable closure member shown generally at 40. Between the moveable closure member 40 and the first end wall 22 there is a hinge 32.

Typically, the hinge 32 is a living hinge, whereby the moveable closure member 40 is adjoined to the first end wall 22 of the base portion 20. However, the hinge 32 may be formed as a two-piece bolt-type or piano-type hinge, where two mating hinge halves are hingingly secured together by a hinge pin. In this case, the hinge pin is put into place and upset at both ends so as to make it impossible to be removed, thus resulting in a unitary structure for the child-resistant closure 10.

Figure 8:
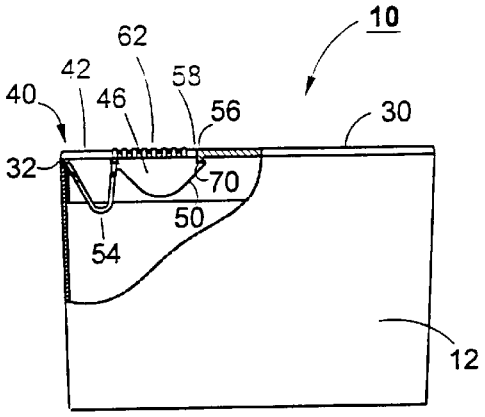

The moveable closure member 40 has a first major surface 42, and a second major surface 44. The first major surface 42 is the upper surface of the moveable closure member 40 when the moveable closure member is in its operative closure position, as seen in FIG. 8. When the moveable closure member is in its operative closure position, the opening 34, which is the less than 50% of the opening defined by the end walls and the sidewalls of the rectangular base portion 20, is covered.

Figure 2:
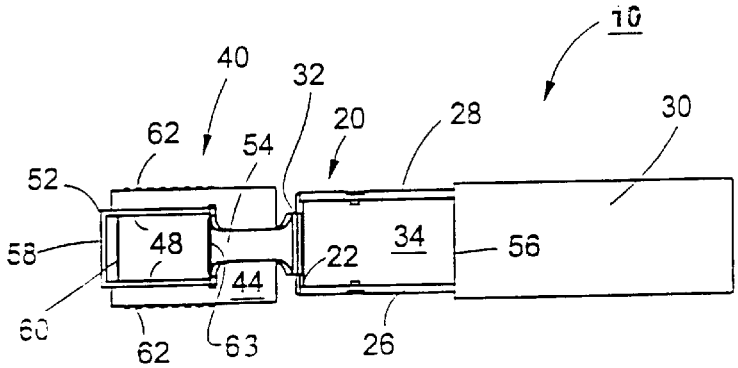
FIG. 2 is a top view of the child-resistant closure of FIG. 1.
Figure 3:
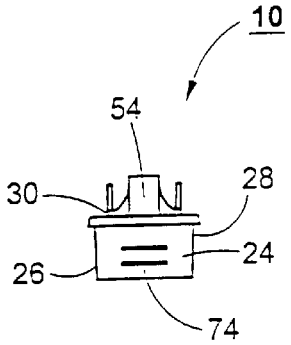
FIG. 3 is an end view of the child-resistant closure of FIG. 1.
Figure 4:
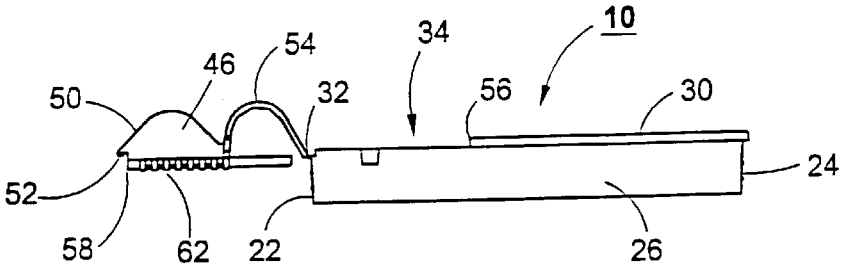
FIG. 4 is a side view of the child-resistant closure of FIG. 1.
Figure 5:
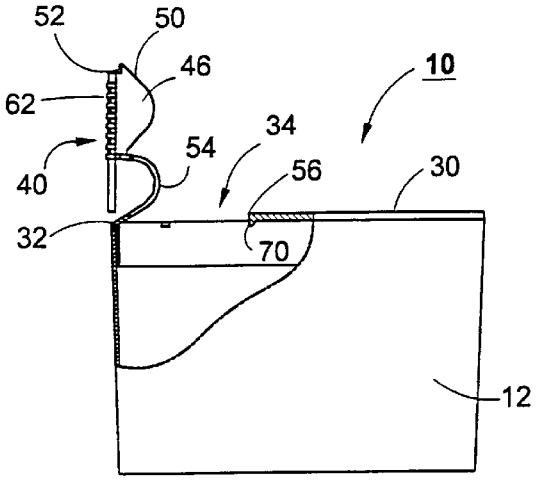
FIGS. 5, 6, 7, and 8 show progressive steps during a closing operation of a child-resistant closure in keeping with a present invention, when placed on a pill container.
Figure 6:
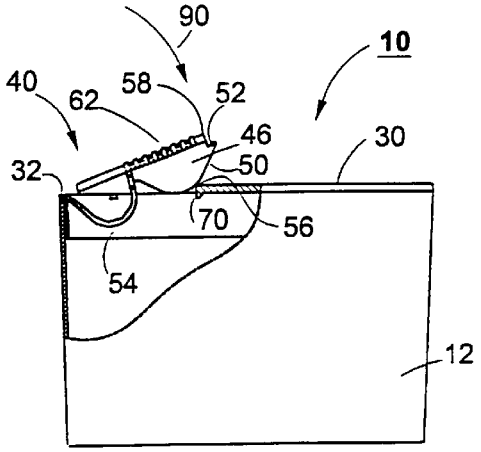
Figure 7:
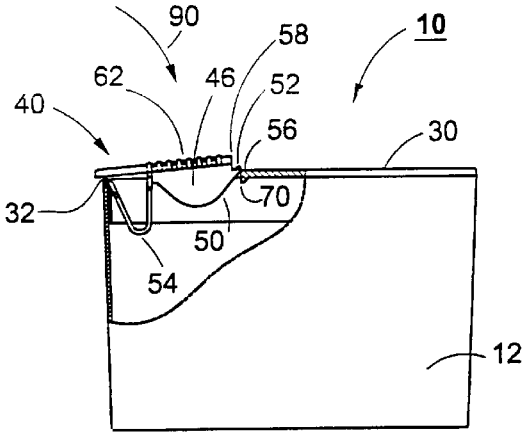

A camming member is shown generally at 46, and it is formed so as to be upstanding from the second major surface 44 at a first end 58 thereof. As will be understood from the discussion hereafter which is particularly directed to FIGS. 5 through 8, the camming member 46 may comprise a single upstanding structure. More typically, however, as can be seen in FIGS. 1, 2, and 3, the camming member 46 comprises a pair of opposed upstanding camming walls 48 which are formed near the edges of the moveable closure member 40.

In any event, the camming member 46 presents at least one sliding cam surface 50. Each sliding cam surface 50 is sloped in a direction towards the second major surface 44 and away from the hinge 32. The operation and purpose of the camming member 46 and the sliding cam surfaces 50 are described in greater detail hereafter.

The camming member 46 has first and second ends such that the sliding cam surface 50 terminates at the first end. Of course, the first end of the camming member 46 is located at the first end 58 of the moveable closure member 40.

Also located at the first end of the camming member 46 is a latch member shown at generally at 52. It will be seen that the latch member extends beyond the first end 58 of the moveable closure member 40, and that it is spaced away from the second major surface 44 by a distance which is at least equal to the thickness of the first fixed cover portion 30.

A flexible spring member 54 is formed between the second end of the camming member 46 and the hinge 32. The flexible spring member 54 terminates at its end which is remote from the second end of the camming member in the hinge 32.

It will be seen from each of FIGS. 1 through 8 that the child-resistant closure 10 is, indeed, formed as a unitary structure. The fixed cover portion 30 is molded integrally with the substantially rectangular base portion 20; the camming member 46 is formed integrally with the moveable closure member 40; and the moveable closure member 40 is formed integrally with the flexible spring member 54 which, in turn, is either formed integrally with the first end wall 22 of the rectangular base portion 20 as part of a living hinge, or is formed with a two-part hinge which is permanently assembled with an unremovable hinge pin.

Thus, it can be seen from FIGS. 1, 2, 4, and 5, for example, that the moveable closure member 40 has an operative open position as shown in those Figures. Moreover, as seen particularly from FIG. 8, the moveable closure member has an operative closure position. When the moveable closure member is in its operative closure position, the latch member 52 extends beneath a first end 56 of the first fixed cover portion 30. Moreover, the first end 58 of the moveable closure member 40 will be urged against the first end 56 of the fixed cover portion 30 by the spring action of the flexible spring member 54.

Typically, the camming member 46 comprises the pair of opposed upstanding camming walls 48 noted above, and a pair of opposed first and second upstanding end walls 60 and 62. The end wall 60 is upstanding from the second major surface 44 of the moveable closure member 40 in a location behind the latch member 52. The flexible spring member 54 terminates at its end remote from the hinge 32 in the second upstanding end wall 62.

For purposes particularly of opening the child-resistant closure 10, as described in greater detail hereafter, the edges of the moveable closure member 40 and the first major surface 42 thereof may have serrations 62 formed therein.

It will be noted from FIGS. 1 through 4, in particular, that the first fixed cover portion 30 extends outwardly beyond the second end wall 24 and the beyond the first and second sidewalls 26 and 28. Likewise, it will be understood from a review of FIGS. 1 and 2, in particular, together with FIG. 8, that when the moveable closure member 40 is in its operative closure position as shown in FIG. 8, it will extend outwardly beyond the first end wall 22 of the base portion 20, and beyond the first and second sidewalls 26 and 28. In particular, the fact that the first fixed cover portion 30 extends outwardly beyond the second end wall 24 and beyond the first and second sidewalls 26 and 28, respectively, assures that the child-resistant closure 10 may be fitted to a pill container 12 in such a manner that the substantially rectangular base portion 20 of the child-resistant closure 10 extends downwardly into the rectangular pill container 12, but only to the extent that there is an interference between the upper surface at the mouth of the pill container 12 and the undersurface of the overhanging portions of the fixed cover portion 30.

Typically, the first fixed cover potion 30 overlies from 60% to 75% of the opening in the rectangular base portion 20 defined by the end walls 22, 24 and the sidewalls 26, 28. That leaves 25% to 40% of the opening to be covered by the moveable closure member 40 when it is in its operative closure position as shown in FIG. 8, for example. Of course, it follows that, when the moveable closure member 40 is in its operative open position, that 25% to 40% of the opening in the rectangular base portion 20 is uncovered by the moveable closure member 40. From that, it follows that a dispensing pharmacist may choose from differing configurations of child-resistant closures in keeping with the present invention, where each closure has the same external dimensions, to be placed over the open mouth of a pill container which may have large pills or small pills therein. If the pills are small, then a configuration of the child-resistant closure member may be chosen by the dispensing pharmacist such that only 25%—or even less—of the opening in the rectangular base portion is open when the moveable closure member 40 is in its operative open position.

To assist the action of the child-resistant closure of the present invention, when the moveable closure member is in its operative closure position, a downwardly extending projection 70 may be formed on the underside of the first fixed cover portion 30, at the first end 56. Thus, when the moveable closure member 40 is in its operative closure position, there will be an interference engagement between the latch 52 and the downwardly extending projection 70. That engagement may be an enhancement to both opening and closing the child-resistant closure of the present invention, so as to gain or preclude access to the prescribed medication in the pill container 12, as discussed hereafter.

It has been noted above that the child-resistant closure of the present invention is intended for use with a pill container 12, also having a substantially rectangular cross-section, and with a substantially rectangular open mouth formed at one end thereof.

So as to provide for engagement of the child-resistant closure 10 to a pill container 12, engaging means such as ridges 74 may be formed in the first and second ends walls 22 and 22 of the base portion 20, and they may also be formed in complimentary first and second end walls 76 and 78 of a pill container 12. Thus, the child-resistant closure 20 may be engagably retained by the respective engaging means in the pill container 12 and on the end walls 22 and 24 of the base portion 20, with the rectangular base portion 20 extending into the pill container past its substantially rectangular open mouth.

Moreover, a label 80 may be adhesively affixed to at least one side surface 82 of the pill container 12, and also at least to the top surface of the first fixed portion 30. This provides for integrity of the assembled child-resistant closure 10 and its respective pill container 12 such that, once the child-resistant closure 10 has been assembled to a pill container 12 , and a label 80 affixed thereto, it cannot then be re-opened.

Figure 9:
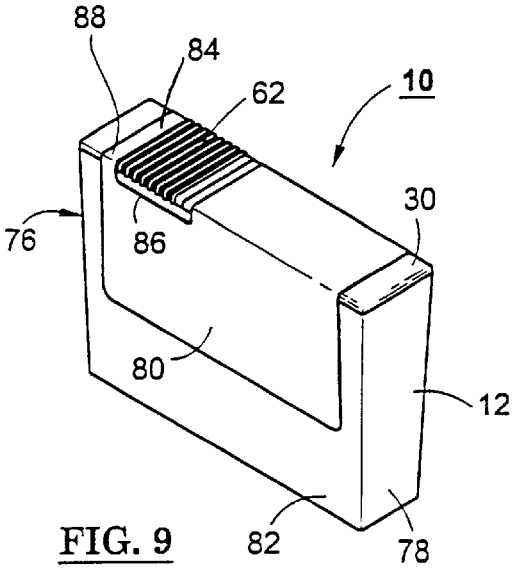
FIGS. 9 and 10 show perspective views of child-resistant closures for pill containers in keeping with the present invention, when placed on pill containers of different sizes, and having a label adhesively affixed to the pill container and to the child-resistant closure.
Figure 10:
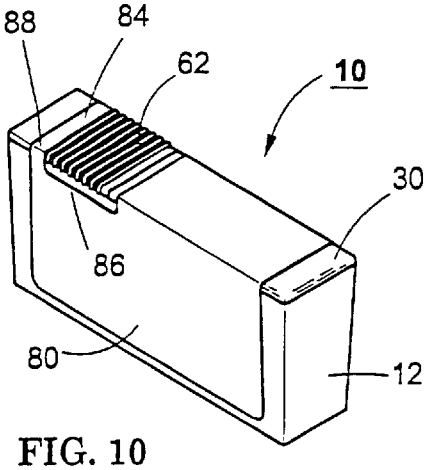

As can be seen in FIGS. 9 and 10, a portion 84 of the label 80 is also adhesively affixed to the first major surface 42 of the moveable closure member 40.

It is also seen in FIGS. 9 and 10 that the label 80 may be die-cut so as to have an opening 86 formed therein, through which the serrations 62 will extend.

Moreover, perforations 88 may be made in the label 80, in the region which is defined at the intersection of the at least one sidewall 82 of the pill container 12 and the first major surface 42 of the moveable closure member 40.

The operation of the child-resistant closure 10, in association with a pill container 12, will now be discussed.

First, it will be assumed that the dispensing pharmacist has filled a prescription by placing the requisite number of pills into a pill container 12 having a suitable volume, and has placed an appropriate child-resistant closure 10 over the pill container 12. At that time, the child-resistant closure 10 will still have a configuration such as that shown in FIGS. 1, 2, and 4—which, it will be clearly understood, is also essentially the configuration that the unitary child-resistant closure 10 of the present invention will assume when it has been opened. In any event, the manipulation and physical movements that are required to close the child-resistant closure 10 are particularly revealed in FIGS. 5 through 8. It will be seen in FIG. 5 that there is still an essentially unrestricted access through opening 34 to the interior of the pill container 12. However, from FIG. 6 it will be seen that the moveable closure member 40 will be moved into its closure position about the hinge 32 so that, in the first instance, there will be an engagement of the sliding cam surface or surfaces 50 with the first end 56 of the fixed cover portion 30. It will be seen from an examination of FIGS. 6 and 7 that, pushing down against the serrations 62 of the moveable closure member 40, in the direction of arrow 90, will cause the first end 58 of the moveable closure member 40 to recede somewhat downwardly and backwardly towards the hinge 32. This, in turn, will have the effect of compressing the flexible spring member 54, as again will be noted from an examination of FIGS. 6 and 7. The purpose of the sliding cam surface or surfaces 50 is, of course, to assure a smooth transition of the position of the moveable closure member 40 from the position shown in FIG. 6 ultimately to the position shown in FIG. 8.

Once the latch 52 has cleared the first end 56 of the fixed cover portion 30, the action of the flexible spring member 54 will be to urge the latch 52 to a position beneath the undersurface of the fixed cover portion 30, and thereby so as to urge the first end 58 of the moveable closure member 40 against the first end 56 of the fixed cover portion 30.

The strength of the flexible spring 54 may be varied from one configuration of child-resistant closure to another, by adjusting the width—or, in some instances, the thickness—of the flexible spring member 54. This adjustment may be necessary, for example, depending on whether the opening 34 is larger or smaller.

To open the child-resistant closure so that the moveable closure member 40 assumes its operative open position, is more or less a reversal of the manipulation required to close the child-resistant closure, except that is also requires a deliberate lifting motion. Thus, reviewing FIGS. 8 and 7, it will be seen that first the moveable closure member 40 must be moved in a direction towards the hinge 32, so that the latch 52 clears the first end 56 of the fixed cover portion 30—and also that it clears the downwardly extending projection 70, if present. That sliding motion is easily accomplished, particularly by engaging the serrations 62 with the thumb or finger. However, it is not enough that the moveable closure member be moved in a direction towards the hinge 32, because unless it is lifted so as to assume a position such as that shown in FIG. 7, the action of the flexible spring member 54 will merely cause the moveable closure member 40 to re-assume a closed position such as that shown in FIG. 8. In other words, a very deliberate slide-and-lift action is required.

The labels 80 are generally die-cut, as shown. However, almost every dispensing pharmacist has a tractor-feed printer on which the labels which will be affixed to any pill container are to be printed. The labels have an adhesive surface on their underside, but they are placed on a release surface on a web which is tractor-fed through the printer. Thus, it will be clearly understood that the printing of labels 80 with any medication instructions, prescription number, the name of the prescribing doctor, and so on, will be no different than has been the case with labels placed on cylindrical pill containers.

It will also be understood that, once the dispensing pharmacist has filled the prescription and placed the child-resistant closure 10 on the pill container 12, and put the label 80 on both the pill container 12 and the child-resistant closure 10, the portion 84 of the label 80, together with the perforations 88, provides a tamper indicator. If the perforations 88 have been broken by a sliding action of the moveable closure member 40, as described above, it will be very evident. Thus, the patient or caregiver can be assured that, in the first instance when they are opening the pill container to gain access to the prescribed medication, it has not been tampered with, and the prescribed medication will be precisely that which has been dispensed by the pharmacist.

Obviously, of course, the labels 80 may be preprinted to place the name of the dispensing drug store location, its logo, or other information such as the telephone number, etc. Moreover, the label 80 can be preprinted with specific instructions as to how to open and close the pill container 12 having the child-resistant closure 10 and label 80 in place thereon.

Of course, it is evident that further instructions, or further medication information, can be placed on the end surface 78 of a pill container 12, or on the top surface, if required.

Figure 11:
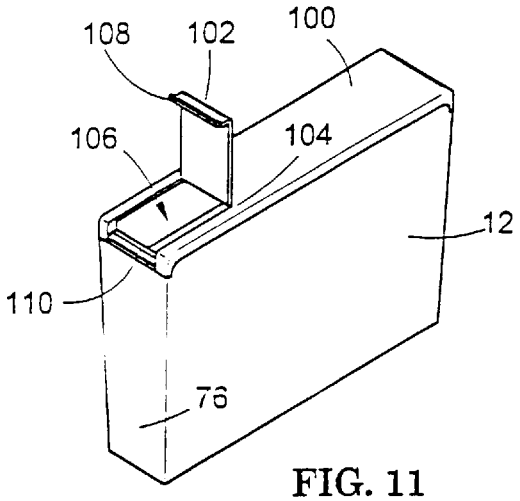
FIG. 11 shows a different closure which may be fitted to a rectangular pill container.
Figure 12:
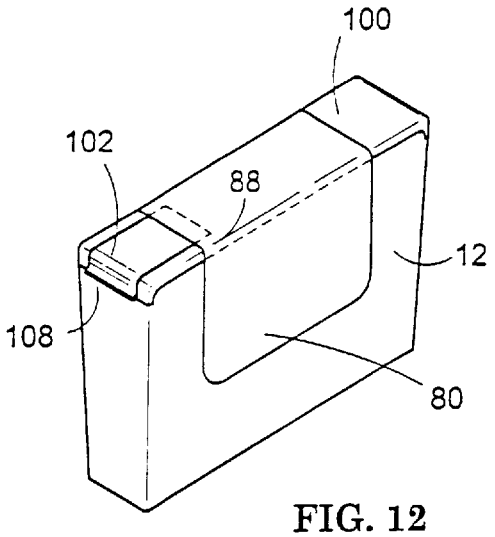
FIG. 12 shows the closure of FIG. 11 in a closed condition, and with a label adhesively affixed to the pill container and closure so as to provide a tamper indicator therefor.

Turning briefly to FIGS. 11 and 12, a further advantage of the child-resistant closure of the present invention, when used in conjunction with a substantially rectangular pill container, and a label such as that described above, can be determined.

FIGS. 11 and 12 show a closure 100 placed on a pill container 12. The closure 100 has a typical fold-back tab 102 which is hinged at 104 to the top of the closure 100 so that, when it is opened in the manner shown in FIG. 11, access is provided through opening 106 to the medications contained within the pill container 112. The tab 102 is generally such that it will snap into place, having an opening edge 108 which snaps over a ledge 110 to close the opening 106.

However, it will be noted from FIGS. 11 and 12 that the closure 100 is such that it functions in much the same manner as ordinary candy dispensers. In other words, the tab 102, being that portion of the closure 100 which covers the opening 106, is opened by being swung upwardly away from the end surface 76 of the pill container 12.

In contradistinction thereto, the moveable closure member 40 swings open in the other direction, away from an end wall 76 of a pill container 12. This is unexpected, and it is particularly to be unexpected by a child who may have knowledge of candy dispensers and their operation.

On the other hand, at least one advantage of the present invention may be obtained even from the use of a closure 100 such as that shown in FIGS. 11 and 12, and that is by use of the label 80. It can happen that use of a closure such as closure 100 may be particularly required for patients who are arthritic or who have other reasons for not wanting to use a child-resistant closure 10. Another example, of course, is that of a caregiver such as a registered nurse in a hospital or nursing home environment, who may want to access prescribed medications for a patient more quickly than might otherwise be possible when opening a child-resistant closure in keeping with the present invention. Nonetheless, that caregiver may be quite concerned that the medication within the pill container is precisely that which was dispensed by the dispensing pharmacist; and, to that end, use of the label 80 having perforations 88 formed therein assures the caregiver that there has been no tampering with the sealed pill container 12 after the label 80 has been placed thereon by the dispensing pharmacist.

A particular advantage to both the pharmacist and the patient from the use of rectangular pill containers, in general, is the fact that a rectangular container may fit more easily into a pocket or purse. Moreover, it has been noted above that the use of rectangular pill containers provides a greater packing density and therefore a better storage efficiency than the use of cylindrical pill containers.

When a rectangular pill container is placed in a medicine cabinet, and particularly when certain information is provided at an end surface 78 or 76 thereof, it may be much more easily determined by the patient or caregiver which pill container contains which medications; and less shelf-space may be required, as well.

The dispensing pharmacist, of course, also can take advantage of the utilization of rectangular pill containers, and their increased storage efficiency. Of course, when the pharmacist is dispensing a prescription, there is access to the interior of a rectangular pill container 12 across the entire width of the pill container at the open mouth thereof, making the placement of the prescribed medication into the pill container more easy. Indeed, the prescribed medication may essentially be swept into the pill container 12. It has also been noted above that various configurations of child-resistant closure 10 may be used with various sizes of pill containers 12, depending on the volume of the overall prescription, and the size of each individual pill of that prescription.

Once the child-resistant closure 10 has been placed on a pill container 12 and a label 80 affixed thereto it is sealed and there is no easy surface or ledge for a child to have access to, either with its fingers or with its mouth and/or teeth. Thus, inadvertent or accidental opening of the sealed pill container is much less likely to happen.

The child-resistant closure of the present invention is typically injection molded using polypropylene—which provides for a pharmaceutically acceptable material, and one which will permit formation of a living hinge in keeping with the present invention. Also, polypropylene has sufficient elastic memory that the spring action of the flexible spring member 54 may be assured. Moreover, polypropylene may be molded with sufficient detail that a two-part hinge may be accurately molded, if necessary or if required.

Typically, pill containers 12 are formed from crystal-polystyrene or mixtures of polypropylene, in much the same manner and using the same materials as conventional cylindrical pill containers.

Indeed, in many respects, a pill container for use with a child-resistant closure in keeping with the present invention may be more easily and less expensively molded, since there is no necessity for special serrations or the like to be formed at the lip or mouth of the pill container.

There has been described a child-resistant closure, and the combination of a child-resistant closure together with a pill container and a label, all in keeping with the general principles of the present invention as defined as described above. It will be understood, of course, that variations may be made to any configuration in keeping with the present invention, and modifications may be made to specific features of the child-resistant closure of the present invention, without departing from the spirit and scope of the appended claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially rectangular is intended to mean rectangular, nearly rectangular, and/or exhibiting characteristics associated with a rectangular configuration.

What is claimed is:

1. A unitary child-resistant closure for pill containers, comprising:

a substantially rectangular base portion having opposed first and second end walls and opposed first and second side walls, and defining an opening therebetween;

a first fixed cover portion overlying more than 50% of said opening, more than 50% of said first and second side walls, and said second end wall;

a second moveable closure member; and a hinge connecting said moveable closure member to said first end wall;

wherein said second moveable closure member has first and second major surfaces;

wherein said first major surface of said moveable closure member is the upper surface thereof when said moveable closure member is in its operative closure position so as to cover the remaining less then 50% of said opening, the remaining less than 50% of said first and second side walls, and said first end wall;

wherein said second major surface of said moveable closure member is the lower surface thereof when said moveable closure member is in its operative closure position;

wherein a camming member is upstanding from said second major surface of said moveable closure member at a first end thereof, and presents at least one sliding cam surface having a portion which is sloped in a direction towards said second major surface and having another portion slopped in a direction away from said hinge;

wherein said camming member has first and second ends, with said sliding cam surface terminating at said first end thereof;

wherein said first end of said camming member has a latch member formed therein, which latch member extends beyond said first end of said moveable closure member and is spaced away from said second major surface; and wherein a flexible spring member is formed between said second end of said camming member and said hinge, and terminates in said hinge at the end of said flexible spring member which is remote from said second end of said camming member;

whereby, when said moveable closure member is in its operative closure position, said latch member extends beneath a first end of said fixed cover portion which is remote from said second end wall, and said first end of said moveable closure member is urged against said first end of said first fixed cover portion by the spring action of said flexible spring member.

2. The unitary child-resistant closure for pill containers of claim 1, wherein said hinge is a living hinge.

3. The unitary child-resistant closure for pill containers of claim 1, wherein said latch member is spaced away from said second major surface by a distance which is at least equal to the thickness of said first fixed cover portion.

4. The unitary child-resistant closure for pill containers of claim 1, wherein said camming member comprises a pair of opposed upstanding camming walls formed near the edges of said moveable closure member on the second major surface thereof; and wherein said latch member is formed in each of said opposed upstanding camming walls.

5. The unitary child-resistant closure for pill containers of claim 4, wherein said camming member comprises said pair of opposed upstanding camming walls and a pair of opposed first and second upstanding end walls;

wherein said first upstanding end wall is upstanding from said second major surface of said moveable closure member in a location behind said latch member; and wherein said flexible spring member terminates at its end remote from said hinge in said second upstanding end wall.

6. The unitary child-resistant closure for pill containers of claim 1, wherein a portion of the edges and a portion of the first major surface of said moveable closure member each have serrations formed therein.

7. The unitary child-resistant closure for pill containers of claim 1, wherein said first fixed cover portion extends outwardly beyond said second end wall, and beyond said first and second side walls.

8. The unitary child-resistant closure for pill containers of claim 1, wherein, when said moveable closure member is in its operative closure position, it extends outwardly beyond said first end wall, and beyond said first and second side walls.

9. The unitary child-resistant closure for pill containers of claim 1, wherein said first fixed cover portion overlies from 60% to 75% of said opening in said rectangular base portion, leaving from 25% to 40% of said opening to be covered by said moveable closure member when it is in its operative closure position; and wherein, when said moveable closure member is in its operative open position, said 25% to 40% of said opening is uncovered by said moveable closure member.

10. The unitary child-resistant closure for pill containers of claim 1, wherein a downwardly extending projection is formed on the underside of said first fixed cover portion at said first end thereof.

11. The unitary child-resistant closure for pill containers of claim 1, in combination with a pill container, said pill container having a rectangular cross-section with a substantially rectangular open mouth formed at one end thereof.

12. The combination of claim 11, wherein engaging means are formed in said first and second end walls of said child-resistant closure, and in first and second end walls of said pill container, whereby said child-resistant closure is engagably retained by said engaging means in said pill container and on said end wall of said child-resistant closure with said substantially rectangular base portion thereof extending into said pill container past said substantially rectangular open mouth thereof.

13. The combination of claim 11, further comprising a label adhesively affixed to at least one side surface of said pill container and at least to the top surface of said first fixed portion of said child-resistant closure.

14. The combination of claim 13, wherein a portion of said label is also adhesively affixed to said first major surface of said moveable closure member.

15. The combination of claim 14, wherein said label has an opening therein through which serrations which are formed in said first major surface and at the edges of said moveable closure member will extend.

16. The combination of claim 15, wherein perforations are made in said label in the region thereof which is defined at the intersection of the at least one side surface of said pill container and said first major surface of said moveable closure member.

* * * * *